United States Patent [19]

Dunaevsky et al.

[11] 4,293,101

[45] Oct. 6, 1981

[54] APPARATUS FOR HELICALLY COILING BANDS AFTER SLITTING WIDE STRIP

[76] Inventors: Vladimir I. Dunaevsky, ulitsa Oktyabrskoi revoljutsii, 27, kv. 9; Nikolai G. Boidenko, ulitsa Lenina, 39, kv. 20, both of Slavyansk Donetskoi oblasti; Alexei P. Samarin, ulitsa Bolshaya Sadovaya, 60, kv. 4, Kramatorsk; Viktor M. Levit, pereulok Silikatny, 10, Slavyansk Donetskoi oblasti; Boris M. Zapara, ulitsa Vrachebnaya, 23, kv. 59, Kramatorsk; Boris N. Ivanov, ulitsa Profinterna, 42; Sergei A. Frolov, pereulok Generala Batjuka, 3, kv. 54, both of Slavyansk Donetskoi oblasti; Rostislav A. Voronin, ulitsa Komsomolskaya, 25, Kramatorsk; Nikolai P. Belozerov, ulitsa Sotsialisticheskaya, 71, kv. 14, Kramatorsk; Valery I. Momot, ulitsa Voznesenskogo, 19, kv. 78, Kramatorsk; Jury A. Stusenko, ulitsa Yasnaya, 25, kv. 42, Slavyansk Donetskoi oblasti; Vladimir A. Samoilov, ulitsa Vorovskogo, 233, Kramatorsk, all of U.S.S.R.

[21] Appl. No.: 105,960

[22] Filed: Dec. 21, 1979

[51] Int. Cl.[3] ..... B65H 35/02; B21C 47/00

[52] U.S. Cl. ..... 242/56.4; 242/80

[58] Field of Search ..... 242/56.4, 56.2, 56.9, 242/78, 78.1, 80, 82

[56] References Cited

U.S. PATENT DOCUMENTS

| | | | |
|---|---|---|---|
| 2,849,193 | 8/1958 | Pauls | 242/78.1 |
| 3,406,924 | 10/1968 | Bruns | 242/56.4 |
| 3,587,993 | 6/1971 | Tradler | 242/80 |
| 3,672,595 | 6/1972 | Jablin | 242/56.2 |
| 3,777,998 | 12/1973 | Jores | 242/56.2 |

*Primary Examiner*—Edward J. McCarthy

*Attorney, Agent, or Firm*—Fleit & Jacobson

[57] ABSTRACT

A coiling apparatus, wherein a band tension regulator is operatively coupled with a hydraulic cylinder for controlling a friction drive of a coiling drum whose rotation speed is governed in a control circuit. The control circuit couples a device for maintaining a constant slip in the friction drive of a coiling drum and a hydraulic drive of a coiler mounted for a reciprocating movement along the axis of the coiling drum, whereby a constant coiling pitch is maintained regardless of variations in the rotation speed of the coiling drum shaft.

4 Claims, 9 Drawing Figures

APPARATUS FOR HELICALLY COILING BANDS AFTER SLITTING WIDE STRIP

BACKGROUND OF THE INVENTION

1. Field of the Invention

The present invention pertains to apparatus for handling metal strip coils and more particularly to apparatus for helically coiling bands after slitting a wide strip. The apparatus of the invention may also be employed for helically coiling bands made from flexible materials other than metallic ones, such as from plastics.

2. Description of the Prior Art

Metal bands are generally produced by lengthwise slitting a continuously moving wider strip, and each band is then coiled on an individual reel. When the bands are narrow, it is desirable to coil them on reels in a helical manner, i.e. to guide a band back and forth along the reel axis in the course of coiling. However, helical coiling poses a problem as to an even laying of the band convolutions and maintaining of a constant band tension as the coil diameter increases. For an adequately shaped coil to be formed, such variables as the reel rotation speed, band tension, and coiling pitch must be maintained at predetermined values, which in many cases is hard to attain.

Attempts have been undertaken to solve this problem by the provision of coiling apparatus wherein the rotation speed of the reels is dependent upon the band tension, of individually-driven coiling drums, of self-contained apparatus and processing lines.

Among numerous constructions directed at solving the problem of helically coiling bands there is known an apparatus disclosed in U.S. Pat. No. 3,587,993. The apparatus comprises a strip uncoiler, a strip-joining device, a slitter for lengthwise slitting of strips into bands, a band separator, and a coiler. The band separator comprises a plurality of rollers arranged in a row and having vertically extending axes. When passing between the band separator rollers, the bands moving in a horizontal plane are twisted through 90° and then enter the coiler zone. The coiler comprises two rows of reels each arranged on a vertical axis and provided with an individual drive.

The reels are installed on a common frame in a horizontal plane. Mounted on the common frame for a vertical movement are two horizontal rails carrying vertical-axis rollers. Each roller is disposed in front of its reel and has an annular groove defined by a flange and a collar movable along the roller axis and adapted to receive a metal band. The collar can be adjusted along the roller axis to vary the width of the groove in accordance with the band width. In the course of helically coiling bands on the reels, the rails with the rollers are raised and lowered by a hydraulic cylinder actuated from a hydraulic pump which provides for a controlled feed of a hydraulic fluid to the hydraulic cylinder. The hydraulic pump is driven by a chain and sprocket drive from the shaft of the front-end reel, which impairs the accuracy of maintaining the tension of the band coiled on this reel and may cause a break of the band. The direction of movement of the rails is reversed by means of a limit switch which, when the rails reach their extreme positions, operates a 4-way valve, causing the piston of the hydraulic cylinder coupled to the rails to move in the reverse direction.

The above-described apparatus features large dimensions and, accordingly, a heavy weight. The use of individual drives of the coiling units makes the coiling station more difficult to attend and increases the cost of the apparatus. Finished coils must be removed by hoisting means in turn from each reel, which lengthens the processing cycle.

The use of rollers with annular grooves for guiding bands restricts the range of strips in terms of thickness thereof, since the edges of thin bands get damaged as the bands shift along the axis of the roller; furthermore, such a construction of the rollers calls for an additional time to change the groove width.

Thus, upgrading the quality of coils, extending the range of bands and raising the productive capacity of the apparatus are hindered by the arrangement of the drive of the reels and by the band guiding means which comprises rollers with an annular groove.

The present invention has as its object to provide an apparatus for helically coiling bands, which ensures a better quality of produced coils, is suitable for coiling of a wider range of bands, and offers a higher productive capacity owing to interdependence between constancy of the tension of the bands, the rotation speed of coiling drums, and the coiling pitch.

SUMMARY OF THE INVENTION

An object of the present invention is to provide an apparatus for helically coiling bands, which ensures a higher quality of produced coils.

A further object of the invention is to provide an apparatus for helically coiling bands, which is suitable for coiling of a wider range of bands.

Still further object of the invention is to provide an apparatus for helically coiling bands, which offers a higher productive capacity.

Yet further object of the invention is to provide an apparatus for helically coiling bands, wherein constancy of the tension of the bands, the rotation speed of the coiling drum, and the coiling pitch are interrelated.

An additional object of the invention is to provide an improved apparatus for helically coiling bands, featuring relatively small weight and dimensions.

The above-mentioned and other objects of the invention are attained by providing an apparatus for helically winding bands after slitting a wide strip, comprising a strip uncoiler, a strip-joining device, a slitter for lengthwise slitting of strips into bands, a band separator, and a coiler with a coiling drum, which apparatus, according to the invention, is provided with a band tension regulator including a pivotally supported double-arm lever having one end carrying a deflecting roller and the other end thereof being pivotally connected to a rod of a hydraulic cylinder whose piston is on its other side provided with further rod coupled to a pressure regulator governing the pressure in the hydraulic control circuit of the hydraulic cylinder serving to control a friction drive of the coiling drum, and the band separator comprises rollers for twisting of bands through 90°, separating rollers, and a roller for reverse twisting of bands whose axis is parallel to that of the coiling drum; a device for maintaining a constant slip in the friction drive of the coiling drum, comprising two rings having ports in a portion adjacent their periphery, one of the rings being mounted on the coiling drum, and the other, on a drum shaft, two yokes each of which spacedly receives the respective ring portion having the ports, is mounted on a support, and is provided at its opposite portions with a light transmitter and a light receiver respectively, the light receivers being connected into a comparison circuit adapted to compare the number of pulses which represent the rotation speed of the coiling drum and of the drum shaft, and a circuit for controlling the rotation speed of the drum shaft; the coiler with the coiling drum arranged on a horizontal axis is installed on a support for movement along the coiling drum axis and, to effect this reciprocating movement, is provided with a hydraulic drive including an electrohydraulic converter connected to an electric control circuit coupled with the light receiver of the yoke operatively connected to the ring mounted on the coiling drum, with a coiling pitch setting device, with a device for setting the number of convolutions in one layer of the coil being wound, and with a detector for sensing the position of the coiler.

Such a construction of the coiler, tension regulator, band separator, and device for maintaining a constant slip in the friction drive of the coiling drum makes it possible to upgrade the quality of coils, since operation of said units is interrelated and their operating variables which considerably affect the coil quality are interdependent, e.g. a change in the band tension brings about a change in the coiling drum rotation speed and, accordingly, in the coiling pitch.

The coiling pitch equals the amount of the coiler movement along the coiling drum axis per one revolution of the drum, and thin bands in the apparatus of the invention are not acted upon by the deformation which occurs in prior art apparatus under the action of the flanges of band-guiding rollers.

The apparatus of the invention makes it possible, without altering the general arrangement of the units, to raise the productive capacity by installing a further band tension regulator, a further band separator, and a further coiling drum on the coiler.

Also, it is preferable that the band separator be provided with a pressure roller with a drive, arranged parallel to the roller for reverse twisting of bands. This provision will make it possible to shorten the time for threading the band ends into the apparatus and securing them to the drums, and hence to increase the productive capacity of the apparatus as a whole, since at the moment of completion of coiling the leading end of each band will remain clamped between the roller for reverse twisting of bands and the pressure roller just in front of the coiling drum.

BRIEF DESCRIPTION OF THE DRAWINGS

The invention will now be described in greater detail with reference to the preferred embodiment thereof, illustrated in the accompanying drawings, wherein.

DETAILED DESCRIPTION OF THE PREFERRED EMBODIMENT OF THE INVENTION

Figure 1:
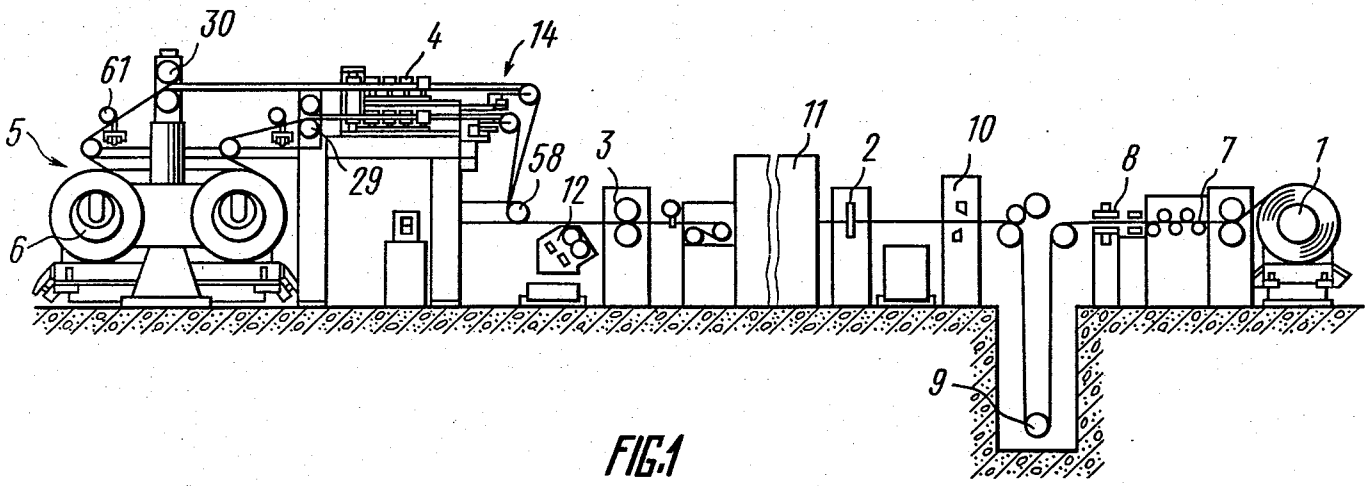
FIG. 1 is a diagrammatic view of an apparatus embodying the concept of the invention.

FIG. 1 diagrammatically illustrates an apparatus for helically coiling bands after slitting a wide strip, which embodies the concept of the invention and wherein the characteristic features of the invention are clearly apparent, although the drawing comprises also features of strip slitting and band coiling lines well known in the art. The apparatus of the invention comprises a strip uncoiler 1, a strip-joining device 2, a slitter 3 for lengthwise slitting of strips into bands, a band separator 4, and a coiler 5 with a coiling drum 6. Besides, commercial installations like the processing line illustrated in FIG. 1 always include devices to carry out auxiliary functions, such as a straightening-and-feeding device 7, strip quality inspection device 8, looping device 9, cross-cutting shears 10, strip surface preparation station 11, edging device 12, and a turnable unloading column 13 diagrammatically shown in light lines in FIG. 2 as forming no part of the invention, but intended only to demonstrate a complete processing cycle.

Figure 3:
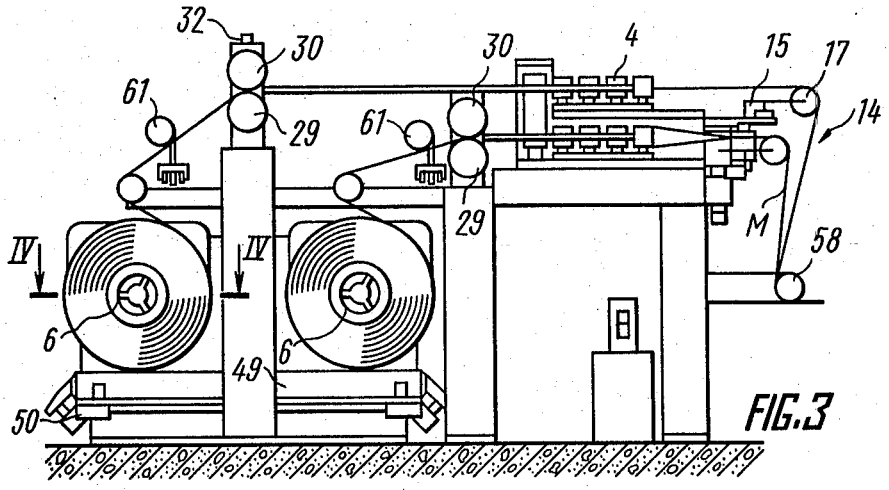
FIG. 3 is an enlarged view of the coiling station.
Figure 5:
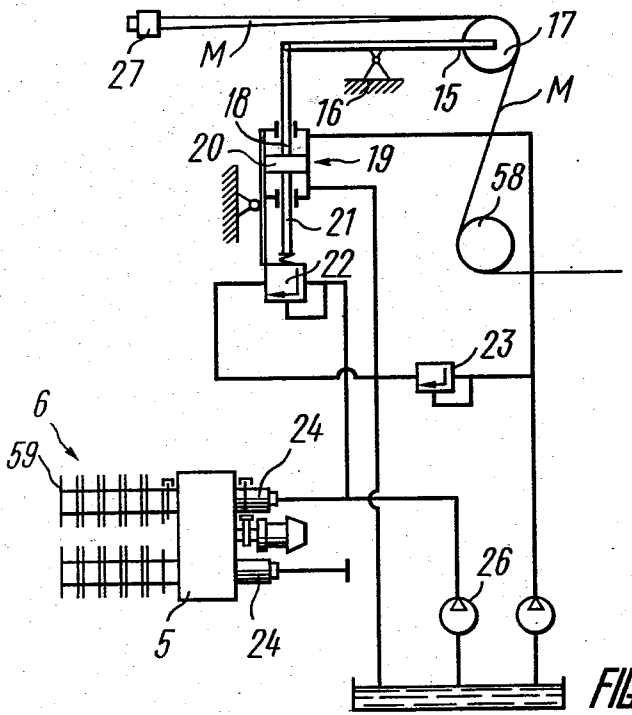
FIG. 5 is a diagram illustrating regulation of the tension of bands.

The invention consists in that the apparatus for helically coiling bands is provided with a band tension regulator 14 illustrated in FIGS. 1, 3, and in greater detail in FIG. 5. The band tension regulator 14 comprises a double-arm lever 15 pivotally mounted on a support 16. One end of the lever 15 carries a deflecting roller 17 which in operation is passed round by a band denoted in the drawings by the letter "M", which stands for "material", and the other end thereof is pivotally connected to a rod 18 of a hydraulic cylinder 19 whose piston 20 is on its other side provided with another rod 21 coupled to a pressure regulator 22. The pressure in the hydraulic cylinder 19, corresponding to a definite amount of tension of the bands passing round the roller 17, is governed by a pressure regulator 23. The pressure regulator 22 is adjusted so that a decline in the tension of the bands passing round the roller 17 causes the piston 20 of the hydraulic cylinder 19 and the rod 21 to move in a direction such as to cause the pressure regulator 22 to increase the pressure in the control circuit of a hydraulic cylinder 24 which serves to control a friction drive 25 of the coiling drum 6. The hydraulic system is fed from pumps 26.

Next, in the direction of travel of bands, there is provided a band separator 4 (FIGS. 1, 2, and 3) comprising rollers 27 for twisting of bands through 90°, separating rollers 28, and a roller 29 for reverse twisting of bands whose axis is parallel to that of the coiling drum 6.

Figure 2:
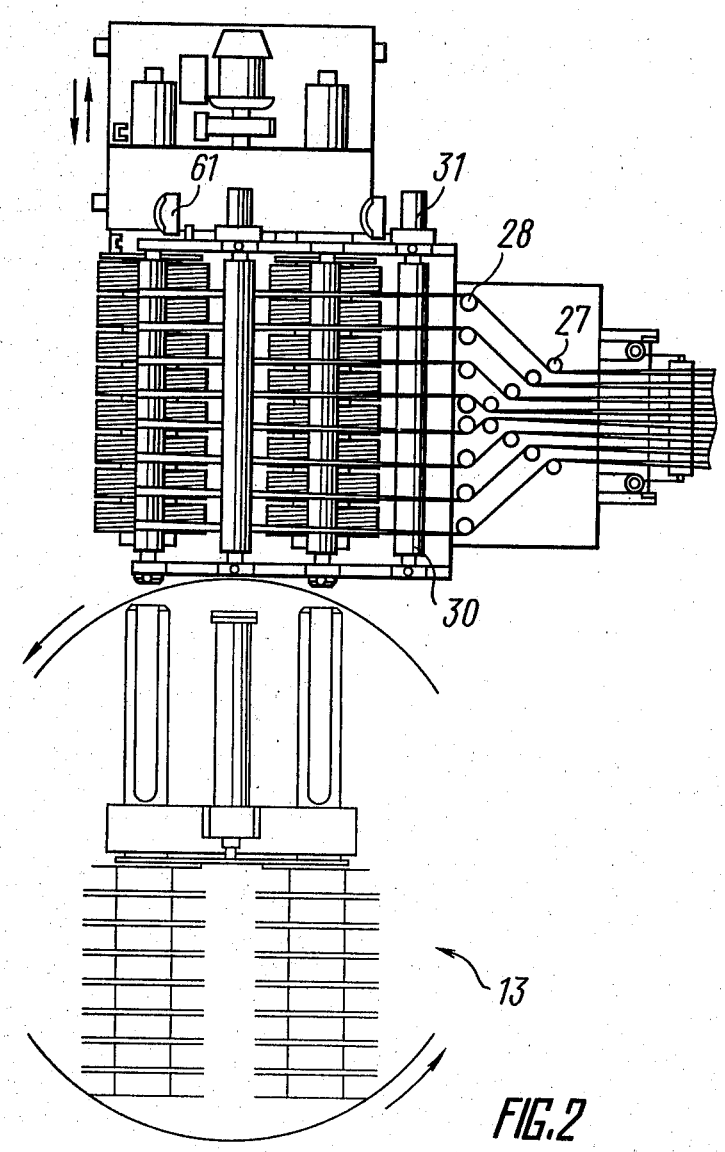
FIG. 2 is a plan view of the coiler.

As shown in FIGS. 2 and 3, the band separator 4 may incorporate a pressure roller 30 with a drive 31, arranged parallel to the roller 29 for reverse twisting of bands. The roller 30 is pressed against the roller 29 by hydraulic cylinders 32.

Figure 4:
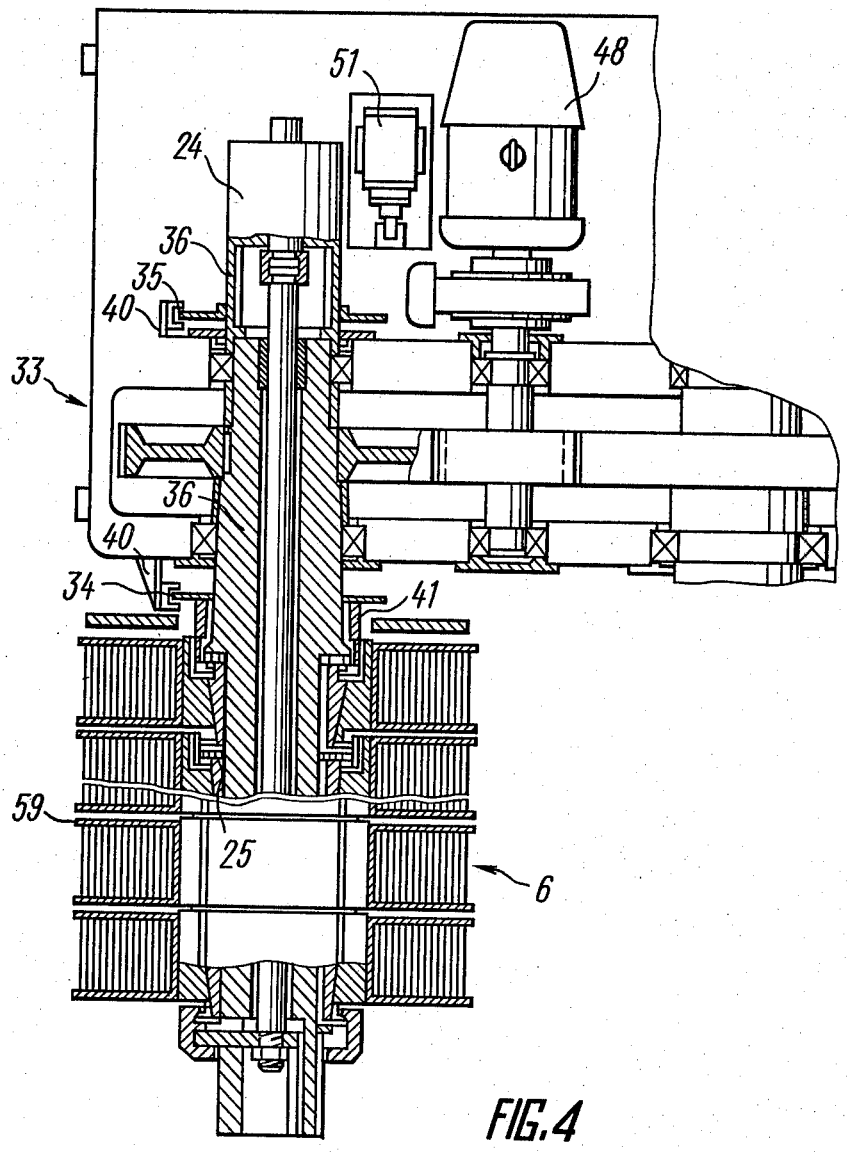
FIG. 4 is a sectional view of the coiler drum, taken along the line IV—IV in FIG. 3.
Figure 6:
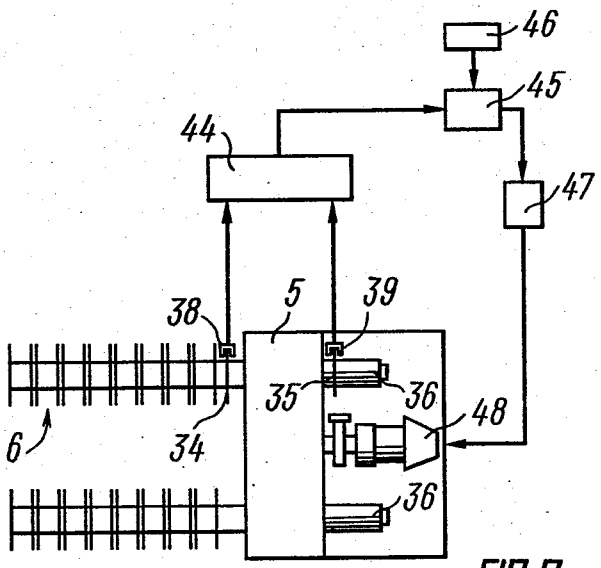
FIG. 6 is a diagram illustrating the device for maintaining a constant slip in the friction drive of the coiling drum.
Figure 7:
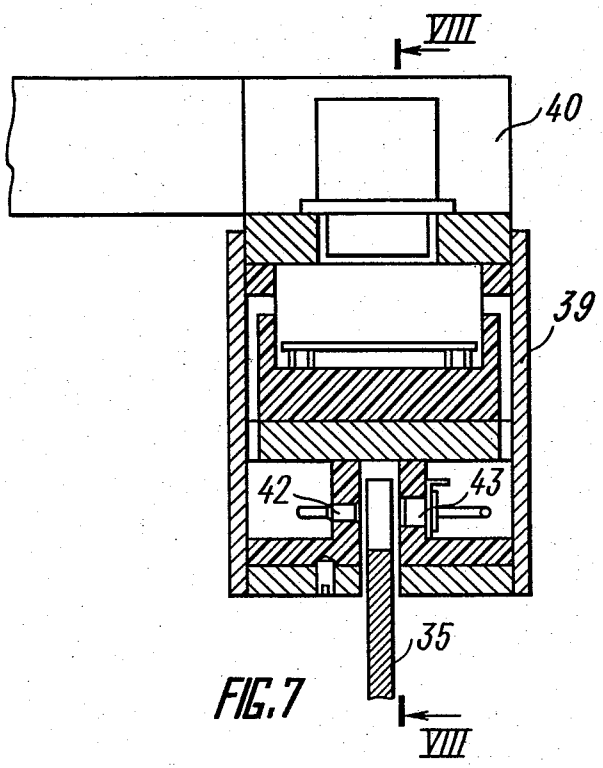
FIG. 7 is an enlarged fragmentary view of the device for maintaining a constant slip in the friction drive of the coiling drum.
Figure 8:
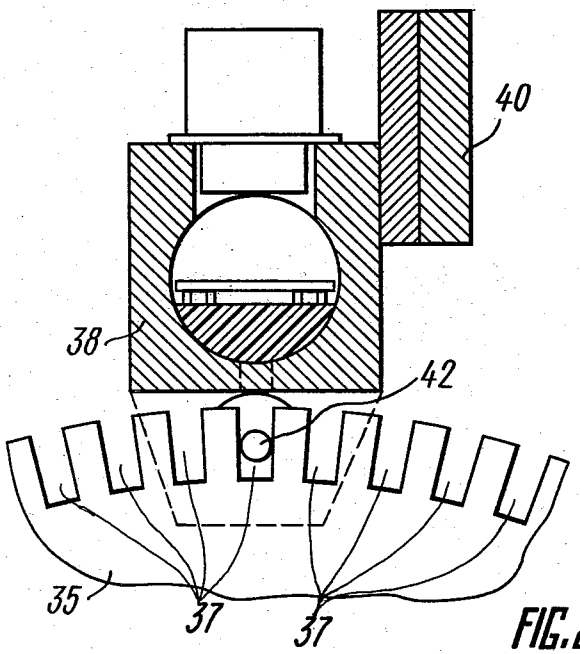
FIG. 8 is a sectional view taken along the line VIII—VIII in FIG. 7.

In accordance with the invention, the apparatus for helically coiling bands is also provided with a device 33 for maintaining a constant slip in the friction drive of the coiling drum 6, which device is depicted more generally in FIGS. 4, 5, and 6, and in greater detail in FIGS. 7 and 8. As shown in FIG. 4, the device for maintaining a constant slip in the friction drive of a coiling drum comprises two identical rings, a first ring 34 and a second ring 35. The first ring 34 is installed on the coiling drum 6, and the second ring 35, on a shaft 36 of the drum. The rings 34 and 35, as is best seen for the ring 35 in FIG. 8, have slots or ports 37 in a portion adjacent their periphery. The first ring 34 and the second ring 35 are spacedly received by a first yoke 38 (FIG. 8) and a second yoke 39 (FIG. 7), but only at the portion having the ports 37, the reason for which will be clear from the further description. As seen in FIG. 4, the yokes 38 and 39 are fixedly mounted on a support, such as a bracket 40, while the rings 34 and 35 are installed respectively on a member 41 belonging to the coiling drum 6 and on the drum shaft 36 should be regarded as rotating.

Referring now to FIG. 8, the yoke 39 is provided with a light transmitter 42 and a light receiver 43, disposed at opposite portions of the yoke and on one and the same axis; the yoke 38 is identical to the yoke 39 and therefore is neither shown in detail in the drawings nor described herein.

The light receivers 43 are connected to a converter 44 (FIG. 6) whose output signal is proportional to the difference in the number of pulses representing the rotation speed of the coiling drum 6 and of the drum shaft 36.

The output of the converter 44 is coupled to a comparator 45 which is coupled with a slip setting device 46. The output of the comparator 45 is coupled with a controlled power source 47 which acts upon a drive 48 rotating the drum shaft 36.

Figure 9:
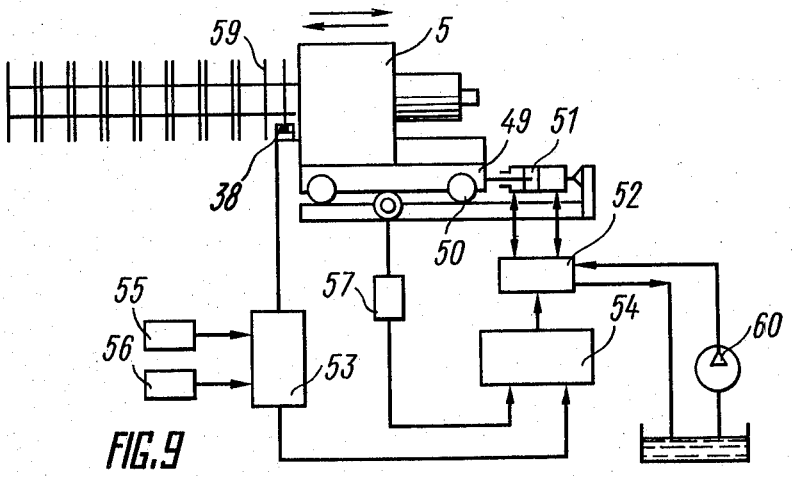
FIG. 9 is a diagram illustrating operation of the coiler in forming cylindrical helical convolutions of a band.

The coiler 5 with the coiling drum 6 arranged on a horizontal axis is installed on a support 49 for a movement on rolls 50 along the axis of the coiling drum 6 and for this reciprocating movement is provided with a hydraulic drive 51 (FIG. 9) incorporating an electrohydraulic converter 52 which is connected to an electric control circuit including a converter 53 and a comparator 54 and coupled with the light receiver 43 of the yoke 38 which is operatively coupled to the ring 34 installed on the drum 6, with a coiling pitch setting device 55, with a device 56 for setting the number of convolutions in one layer of the coil being wound, and with a detector 57 for sensing the position of the coiler 5.

When two coiling drums 6 are installed on the coiler 5, the apparatus is correspondingly provided with one more band tension regulator 14 and with one more band separator 4.

The apparatus of the invention functions as follows.

The coils of a wide strip to be processed are placed on the uncoiler 1. The front end of the strip is bent off and with the aid of the device 7 is pulled through the strip quality inspection device 8 and the looping device 9 to the shears 10. For this time, i.e. during the threading-in period, the roller 9' of the looping device is lifted to the top position, as shown in broken lines in FIG. 1. After removing defective portions, the front end of the strip is fed to the station 11 and then through the slitter 3. On passing a deflecting roller 58, the bands are alternately distributed into two branches: e.g. even bands are fed to the top branch, and odd bands, to the bottom one. Both branches pass round the deflecting rollers 17 of the regulators 14 and then in the band separators 4 are twisted through 90° by the rollers 27, separated or brought apart by the rollers 28, and reverse-twisted by the rollers 29. Next, the bands are, with the aid of the pressure rollers 30, fed to the coiling drums 6 where each band is secured to its reel 59.

Then the tension regulators 14, the devices 33 for maintaining a constant slip in the friction drives 25 of the coiling drums 6, and the hydraulic drive 51 for reciprocation of the coiler 5 are put into operation. The apparatus is brought to the working speed, and the bands are coiled into heavy-weight coils. Abutting and joining of wide strips at the head part of the apparatus, to ensure continuity of the process, are performed with the aid of the strip-joining device 2. During the butt-joining and the removal of finished coils the apparatus is stopped. After the strip quality inspection device 8 has detected defects in the strip, such as pinholes, deviations in thickness, etc., the apparatus is stopped, the defective portion is cut out by the shears 10, whereupon the strips are abutted and joined by the device 2.

The band tension regulator 14 functions as follows. The hydraulic cylinder 19 is fed from the pressure regulator 23 with a hydraulic fluid under a pressure corresponding to the required amount of tension of the bands passing round the deflecting roller 17. Moving under the action of the pressure, the rod 21 of the hydraulic cylinder 19 acts upon the pressure regulator 22, and the latter produces in the hydraulic cylinder 24 a pressure required for frictionally actuating the coiling drum 6.

In operation, the drum shafts 36 rotate at a speed exceeding the strip feeding speed by a preset amount maintained with the aid of the device 33 for maintaining a constant slip in the friction drive of the coiling drum. The slip and an axial force in the friction pairs of the drive 25 of the drums 6 give rise to a torque which ensures a tension of the bands on each reel 59. The tension of all the bands is automatically maintained constant, regardless of the diameters of the coils being wound and of friction, by the band tension regulators 14 through retaining the deflecting rollers 17 in equilibrium under the action of, on one hand, the preset pressure in the hydraulic cylinder 19, and on the other hand, the resultant from the tension of the bands passing round the rollers 17. When the equilibrium gets upset, the bands shift the rollers 17 to one side, and the hydraulic cylinders 19 shift them to another side, with the result that the pressure regulators 22 increase or reduce the pressure in the hydraulic cylinders 24 to exert a counteraction (when the band tension rises, the pressure is reduced, and vice versa). With the parallel arrangement of all the units in conformity with the number of band branches (the embodiment under consideration has two such branches), each hydraulic cylinder 24 is controlled by its tension regulator.

The device 33 for maintaining a constant slip in the friction drive of the coiling drum functions as follows. In the course of coiling, bands are fed to the coiler 5 at a speed governed by the pressure rollers 30. The reels 59 which are each rigidly coupled with the respective coiling drum 6 and with the band being coiled on the reel must rotate at an angular velocity conforming with the band feeding speed. Rotation of the drum shafts 36 in the course of coiling at a speed exceeding that of the drums 6 by the amount of slip is provided by the drive 48. The amount of slip is set by means of the slip setting device 45, wherefrom a signal is delivered to the comparator 45 whose another input receives from the converter 44 a signal proportional to the difference in the number of pulses incoming from the light receivers 43 and representing the rotation speed of the coiling drum 6 and of the drum shaft 36.

The output signal from the comparator 45 controls the power source 47 which acts upon the drive 48 to correct the rotation speed of the drive and hence of the drum shafts 36. The amount of slip is set proceeding from the optimum friction conditions in the friction pairs of the drive 25. The slip also eliminates the effect of the values of the diameters of the coils being wound upon the tension and the correctness of helical coiling.

Consider now operation of the drive 51 reciprocating the coiler 5 to attain helically coiling the bands. The coiling pitch and the number of convolutions in one layer of the coil to be wound are preset respectively by means of the setting devices 55 and 56 according to the width of the bands and the width of the coils being formed. Signals from the setting devices are through the converter 53 delivered to the comparator 54 whose output signal is applied to the electrohydraulic converter 52 which governs the feed rate of hydraulic fluid from a pump unit 60 to the hydraulic cylinder 51 reciprocating the support 49. Helically coiling bands is accomplished as a result of axially moving the drum 6 concurrently with its rotation. Conformity of the amount of the axial movement of the drum 6 per unit angle of its rotation with the preset value is monitored with the aid of the light receiver 43 operatively coupled to the ring 34 mounted on the coiling drum 6, and of the coiler position detector 57, signals wherefrom are applied to the inputs of the comparator 54 for comparing the actual movement of the coiler 5 with the preset one. Owing to this, the coiling pitch is maintained constant regardless of the coiling speed and of the diameter of a coil being wound. The direction of movement of the coiler 5 is reversed with the aid of the device 56 for setting the number of convolutions in a layer, which makes for the required width of the coils.

After the coils have reached the specified weight, the apparatus is stopped, the bands are cut by shears 61, and the band ends are held in the apparatus by the pressure rollers 30. The coiler 5 is, with the aid of hydraulic cylinder 51, shifted to a position where the rod of the hydraulic cylinder 51 is fully extended, and the finished coils are removed with the aid of the turnable unloading column 13. Next, the coiler 5 with empty reels is withdrawn to the initial position, i.e. a position where the rod of hydraulic cylinder 51 is fully retracted, the band ends are secured to the reels, and the apparatus is ready for the next coiling cycle.

It is to be understood that the form of the present invention, herewith shown and described, is to be taken as a preferred embodiment, and that various changes in the shape, size, and arrangement of parts may be resorted to without departing from the spirit of the invention or from the scope of the claims below.

What is claimed is:

1. In an apparatus for helically coiling bands after slitting a wide strip, comprising:

a strip uncoiler, a strip-joining device, a slitter for lengthwise slitting strips into bands, a coiler installed on a support for rectilinear movement and including a coiling drum having an axis arranged in a horizontal plane, a drum shaft freely carrying said coiling drum for rotation thereof on said shaft, a friction drive for said coiling drum actuating from said drum shaft, a hydraulic cylinder for reciprocal movement of said coiling drum in the direction of the axis of said coiling drum, and an electrohydraulic converter for controlling by said hydraulic cylinder the reciprocal movement of said coiling drum;

a device for maintaining a constant slip in the friction drive of said coiling drum, including:

a first ring and a second ring, each having ports in a portion adjacent their periphery, the first ring being installed on said coiling drum, and the second ring being installed on said drum shaft, a first yoke and a second yoke, each of which spacedly receives respective said portion of the first ring and of the second ring, said first yoke and said second yoke each having ports, and each being mounted on a support, and light transmitters and light receivers, one of said light transmitters and one of said light receivers being installed, respectively, at opposite portions of said first yoke and of said second yoke, respectively, on both sides of said first ring and said second ring for transmitting and receiving, respectively, pulses representing the rotation speed of said coiling drum and of said drum shaft, respectively;

a comparison circuit connected to each of said light receivers for comparing the number of said pulses representing the rotation speed of said coiling drum and of said drum shaft to deliver a control signal;

a circuit for receiving the control signal from said comparison circuit and for controlling drive of said drum shaft and the rotation speed of said drum shaft;

an electric control circuit for controlling said hydraulic cylinder for reciprocating movement of said coiler drum, and connected to said light receiver of said first yoke, and comprising:

a comparison device for comparing an actual movement of said coiler drum with a predetermined movement, and connected to said electrohydraulic converter for regulating hydraulic mixture supply to said hydraulic cylinder for reciprocating said coiling drum, a pulse converter for converting said pulses from said light receivers into electric signals corresponding to said predetermined movement of said coiler drum, a coiling pitch setting device connected to said pulse converter, a setting device connected to said pulse converter for setting the number of convolutions in one layer of the coil being wound, and a coiler position detector for detecting actual movement of said coiler, and providing a corresponding signal as an input to said comparison device;

a band tension regulator including a double-arm lever pivotally mounted on a support;

a deflecting roller carried on one end of said lever; and control means connected to the other end of said double-arm lever, and having a control output, and responsive to a decline in tension of the bands passing around said deflecting roller for adjusting said control output;

said control means comprising a hydraulic control circuit for controlling said hydraulic cylinder to control said friction drive, and comprising:

a pressure regulator, and a further hydraulic cylinder having a piston provided with a first rod and a second rod, said rods being disposed on opposite sides of said piston, the first rod being pivotally connected with the other end of said double-arm lever, and the second rod being coupled with said pressure regulator.

2. An apparatus as claimed 1, further comprising a band separator, said band separator comprising a pressure roller and a drive mounted parallel to the pressure roller for reverse-twisting of bands.

3. An apparatus as claimed in claim 2, wherein a further coiling drum is installed on the coiler.

4. An apparatus as claimed in claim 1, further comprising a band separator, and wherein a further coiling drum is installed on the coiler.

* * * * *